US005958658A

United States Patent [19]

Smith et al.

[11] Patent Number: 5,958,658

[45] Date of Patent: Sep. 28, 1999

[54] LUBRICANT FOR AG HALIDE PHOTOGRAPHIC ELEMENTS

[75] Inventors: Dennis E. Smith, Rochester; Yongcai Wang; Charles C. Anderson, both of Penfield; John L. Muehlbauer, Rochester, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/879,062

[22] Filed: Jun. 19, 1997

[51] Int. Cl.[6] ..... G03C 1/795; G03C 1/93; G03C 1/76

[52] U.S. Cl. ..... 430/533; 430/536; 430/537; 430/961

[58] Field of Search ..... 430/527, 536, 430/537, 539, 627, 628, 961, 533

[56] References Cited

U.S. PATENT DOCUMENTS

| | | | |
|---|---|---|---|
| 3,121,060 | 2/1964 | Duane | 252/56 |
| 3,489,567 | 1/1970 | McGraw | 96/85 |
| 4,766,059 | 8/1988 | Vandenabeele et al. | 430/531 |
| 5,455,320 | 10/1995 | Muehlbauer et al. | 526/207 |
| 5,695,919 | 12/1997 | Wang et al. | 430/536 |
| 5,709,986 | 1/1998 | Smith et al. | 430/536 |
| 5,858,634 | 1/1999 | Wang et al. | 430/537 |
| 5,866,312 | 2/1999 | Wang et al. | 430/537 |

*Primary Examiner*—Richard L. Schilling
*Attorney, Agent, or Firm*—Carl F. Ruoff

[57] ABSTRACT

The present invention is an imaging element which includes a support, at least one light sensitive layer, and a surface protective layer containing a binder and polymer particles. The polymer particles are prepared by the process of mechanically forming droplets of an ethylenically unsaturated monomer having hydrophobic groups, the hydrophobic groups having a $\log P_{(calc)}$ greater than a $\log P_{(calc)}$ of the ethylenically unsaturated monomer by at least 1 unit, and a water insoluble lubricant. The droplets are polymerized in the presence of a dispersing agent so that the polymerized droplets have a size of less than 500 nm. The present invention also is an imaging element which includes a support, at least one imaging layer, and at least one layer containing a binder and polymer particles. The polymeric particles are prepared by the process of mechanically forming droplets of an ethylenically unsaturated monomer having a $\log P_{(calc)}$ greater than 4, preferably greater than 6, and a water-insoluble lubricant and polymerizing the droplets in the presence of a dispersing agent so that the polymerized droplets have a size of less than 500 nm.

19 Claims, No Drawings

LUBRICANT FOR AG HALIDE PHOTOGRAPHIC ELEMENTS

CROSS REFERENCE TO RELATED APPLICATIONS

This application relates to commonly assigned copending application Ser. No. 08/879,059 now U.S. Pat. No. 5,858,634 filed simultaneously herewith and hereby incorporated by reference for all that it discloses. This application relates to commonly assigned copending application Ser. No. 08/878,060 filed simultaneously herewith and hereby incorporated by reference for all that it discloses. This application relates to commonly assigned copending application Ser. No. 08/878,791, now U.S. Pat. No. 5,866,312 filed simultaneously herewith and hereby incorporated by reference for all that it discloses. This application relates to commonly assigned copending application Ser. No. 08/878,718 filed simultaneously herewith and hereby incorporated by reference for all that it discloses.

FIELD OF THE INVENTION

This invention is related to an imaging element with improved physical properties of its surface layer. In particular, this invention relates to a method of making uniformly sized polymer particles for use in imaging elements. The polymer particles have a mean size of less than 500 nm and are impregnated with a water-insoluble lubricant The polymer particles are used to form a surface protective layer for the imaging element and provide surface slip properties and resistance to physical and mechanical scratch and abrasion.

BACKGROUND OF THE INVENTION

During the handling of a photographic material, such as coating, drying, finishing, winding, rewinding, printing, projecting, and so on, the material surfaces are often harmed by contact friction with other apparatus and between its front and back faces. For example, scratches or abrasions can be brought about on the emulsion and back sides of a photographic material. These scratches or abrasion marks are visible during printing or projecting processes. This causes serious problems in the practical use of the films. Moreover, when the contact friction is high, the photographic materials do not transport smoothly during the manufacturing process or in various exposure, processing, and projection machines. These transport problems may result in product waste. In recent years, the conditions under which the photographic materials are manufactured or utilized have become more severe, because their applications have been extended (for example, in an atmosphere of high humidity and high temperature) or because the methods for their preparation have been advanced (for example, high speed curtain coatings, high speed finishing and cutting, and fast processing). Under these conditions, the photographic materials are more easily scratched.

To lower the contact friction and improve the resistance to damage to surfaces, a lubricant or slipping agent is often used. Examples of the lubricants used for those purposes include silicone fluids as described in U.S. Pat. No. 3,489,567, and wax esters of high fatty acids or high fatty alcohols in U.S. Pat. No. 3,121,060. Problems are encountered in the use of these lubricants. For example, waxes such as Carnauba wax have been used to form the backing lubricant layer. However, they need to be coated from solvents such as propylene dichloride, which is on the EPA P/U highly hazardous list. Furthermore, waxes in most cases have to be applied as a separate layer, which requires an additional coating station and therefore increases product cost.

U.S. Pat. No. 4,766,059 describes a method of making solid spherical beads having a mean size ranging form 0.5 to about 20 $\mu$m. The polymer beads contain a polymeric resinous material and a water insoluble wax. However, the process of making such solid beads involves the use of water miscible or immiscible low boiling solvent to dissolve both polymeric materials and wax, and subsequently removal of the solvent or solvent mixture by evaporation. This requires large processing equipment and lengthy processing time, which increases the expenses of making these beads.

In other cases, it is also possible to make lubricant impregnated polymer particles by emulsion polymerization. In such a process, lubricant is first dissolved in an ethylenically unsaturated monomer, and the resultant mixture is added to an aqueous phase that contains surfactants above the critical micelle concentration and a water-soluble initiator. The mechanism of the polymerization process has been subject of much research and is generally agreed to include diffusion of monomer (in this case, both monomer and lubricant) from the monomer droplet (or monomer lubricant droplet) formed by agitation to the growing polymer particles where the actual polymerization proceeds. Thus, such a process is not very stable and lubricant can form oily-like scum in the reaction medium causing latex particles to coagulate.

Therefore, a foremost objective of the present invention is an improved method of making uniformly sized polymer particles for use in imaging elements. The polymer particles have a mean size of less than 500 nm and are impregnated with a water-insoluble lubricant. The polymer particles can be applied from a low hazard organic solvent or solvent mixture and are used to form surface protective layers for imaging element that provide surface slip properties and resistance to physical and mechanical scratch and abrasion.

SUMMARY OF THE INVENTION:

The present invention is an imaging element which includes a support, at least one light sensitive layer, and a surface protective layer containing a binder and polymer particles. The polymer particles are prepared by the process of mechanically forming droplets of an ethylenically unsaturated monomer having hydrophobic groups, the hydrophobic groups having a logP(calc) greater than a $\log P_{(calc)}$ of the ethylenically unsaturated monomer by at least 1 unit, and a water insoluble lubricant. The droplets are polymerized in the presence of a dispersing agent so that the polymerized droplets have a size of less than 500 nm. The present invention also is an imaging element which includes a support, at least one imaging layer, and at least one layer containing a binder and polymer particles. The polymeric particles are prepared by the process of mechanically forming droplets of an ethylenically unsaturated monomer having a $\log P_{(calc)}$ greater than 4, preferably greater than 6, and a water-insoluble lubricant and polymerizing said droplets in the presence of a dispersing agent so that the polymerized droplets have a size of less than 500 nm.

DETAILED DESCRIPTION OF THE INVENTION

In accordance with the present invention, the polymer particles are prepared by the process of mechanically forming oil-in-water droplets having a mean size of less than 500 nm. Preferably less than 250 nm, and comprising a water-insoluble lubricant, an ethylenically unsaturated monomer and a compound having a higher $\log P_{(calc.)}$ value than the monomer by at least one unit or an ethylenically unsaturated monomer having a $\log P_{(calc.)}$ value greater than 4; preferably greater than 6, and polymerizing the oil-in-water droplets using a free radical initiator to form solid polymer particles having a mean size that is essentially the same as the oil-in-water droplets.

The process of the instant invention differs from traditional suspension and emulsion polymerization. In traditional suspension polymerization, a polymerizable liquid is dispersed as droplets in a continuous aqueous medium and polymerized under continuous agitation. Normally, the process is carried out in the presence of a "granulating agent", such as a lyophilic polymer (starch, natural gums, polyvinyl alcohol, or the like) or an insoluble fine powder such as calcium phosphate. These granulating agents help to obtain a dispersion of droplets of the polymerizable liquid but do not provide sufficient stabilization of the dispersion so that the dispersed droplets are stable in the absence of agitation. Therefore, in the suspension polymerization method, it is necessary to carry out the polymerization under continuous high energy mechanical agitation, since otherwise extensive coalescence of the droplets will occur, with separation of a bulk phase of water-immiscible, polymerizable material or the formation of large amounts of coagulum. Because the process depends on the details of the shear field in the reactor and on the changing viscosity of the polymerizing dispersed phase, it is difficult to control reproducibly, is not readably scaleable, and gives broad particle size distributions (PSD).

In conventional emulsion polymerization, on the other hand, ethylenically unsaturated monomers are added to an aqueous phase, which contains surfactant above the critical micelle concentration and a water-soluble initiator. The mechanism of the polymerization process has been subject of much research and is generally agreed to include emulsification of monomer into a continuous aqueous phase to form monomer droplets having a size of about 1 to 10 $\mu$m and diffusion of the monomer from the monomer droplets into surfactant micelles where the actual polymerization proceeds. Homogeneous nucleation will also occur for recipes with low surfactant concentration or monomers of relatively high water solubility, but polymerization in the monomer droplets is deemed insignificant. Thus, monomer droplets are formed to a size much larger than the resultant polymer particles and function solely as reservoirs holding the monomer until it diffuses into the growing micelles.

The preparation of polymer particles in accordance with the present invention involves dispersing the water-insoluble monomer in the presence of a dispersion stabilizer or granulating agent to the desired size by using a mechanical shearing device such as an agitator, a high pressure homogenizer, colloid mill, an ultrasonic horn or the like, and carrying out polymerization with little or minimal stirring (only enough to prevent creaming and to provide good thermal transfer). This differs from suspension polymerization in which the polymerization is carried out under continuous high energy mechanical agitation as already described.

For any given monomer, the energy required to form monomer droplets smaller than 500 nm, Preferably less than 250 nm is significantly greater than the energy required to form monomer droplets from 1 to 10 $\mu$m as previously described for emulsion polymerization where the monomer droplets are used as reservoirs and disappear by diffusion as the polymerization proceeds. Any of the above listed equipment, as long as it imparts sufficient shearing energy, can be used in the practice of the instant invention. Sufficient shearing energy is provided by approximately a rate of shear (or velocity gradient) of $10^5$ $min^{-1}$ or greater, more preferably $10^6$ $min^{-1}$ or greater. By rate of shear is meant is a value obtained by dividing an absolute value of a difference of speeds of two planes by a distance between said two planes. A high pressure homogenizer operated at 1400 psi provides a rate of shear approximately equal to $6\times10^6$ $min^{-1}$. High pressure homogenizers are preferred.

In conventional emulsion polymerization, the principal locus of particle nucleation is the aqueous phase or the monomer swollen micelles depending on the degree of water solubility of the monomers and the amount of surfactants used; lowering water solubility of monomer and higher amounts of surfactants would favor nucleation in monomer swollen micelles. Monomer droplets are only considered to act as monomer reservoirs supplying monomers to the growing polymer particles. Therefore, particle size and size distribution are very sensitive to the type and amount of surfactants, initiator concentration and decomposition kinetics, reaction temperature, comonomers, ionic strength, and impurities such as oxygen present in the reaction medium. In the polymerization process of the present invention, the polymer particles size and size distribution are controlled by controlling the monomer droplet size and distribution. The small sizes of monomer droplets generated by homogenization are principal locus of particle nucleation. The particle size and size distribution become strongly dependent on the amount of mechanical energy and shear used in the homogenization step, and less dependent on the type and amount of surfactants, and initiator concentration.

Various dispersion stabilizers or granulating agents which can be used in the practice of the present invention are well known in the art, they include, for example, surfactants such as sodium dodecylsulfate or sodium dioctylsulfosuccinate, and hydrophilic polymers, for example, polyvinyl alcohol, gelatin, methyl cellulose, methyl hydroxypropyl cellulose, ethyl cellulose, sodium salt of carboxymethyl cellulose, polyacrylic acid and salts thereof, starch, gum, alginic acid, zein, casein, etc.

Polymer particles produced by the process of the present invention are required to contain hydrophobic groups in order to prevent diffusion growth of the droplets prior to polymerization. The hydrophobic group can be any compound present in the monomer droplets, but preferred is a non-reactive compound. Any of the non-reactive compounds having hydrophobic properties defined in terms of $\log P_{(calc)}$ as set forth in commonly owned U.S. Pat. No. 5,455,320, issued Oct. 3, 1995, may be used. $\mathrm{Log}P_{(calc)}$ is the logarithm of the octanol-water partition coefficient calculated using Medchem version 3.54, a software package available from Medicinal Chemistry Project, Pomona College, Clairmont, Calif. The software package is well known and accepted in the chemical and pharmaceutical industries. $\mathrm{Log}P_{(calc)}$ is a parameter which is highly correlated with measured water solubility for compounds spanning a wide range of hydrophobicity. The hydrophobic compounds used in the present invention are either liquid or oil soluble solids. As indicated above, the non-reactive compound is more hydrophobic than that of the monomer or monomers and has a higher $\log P_{(calc)}$ than the monomer by at least 1 unit and more preferably by 3 units. Suitable non-reactive hydrophobic compounds are those selected from the following classes of compounds, among others:

I. Saturated and unsaturated hydrocarbons and halogenated hydrocarbons, including alkanes, alkenes, alkyl and alkenyl halides, alkyl and alkenyl aromatic compounds, and halogenated alkyl and alkenyl aromatic compounds, especially those having a $LogP_{(calc)}$ greater than about 3.

II. Esters of saturated, unsaturated, or aromatic carboxylic acids containing a total of about 10 or more carbon atoms, especially those having a $LogP_{(calc)}$ greater than about 3.

III. Amides of carboxylic acids having a total of 10 or more carbon atoms, especially those having a $LogP_{(calc)}$ greater than about 3.

IV. Esters and amides of phosphorus- and sulfur-containing acids having a $LogP_{(calc)}$ greater than about 3, and other compounds of similar hydrophobicity.

Compounds of Class I include: straight or branched chain alkanes such as, for example, hexane, octane, decane, dodecane, tetradecane, hexadecane, octadecane, 2,2,6,6,9,9-hexamethyldodecane, eicosane, or triacontane; alkenes such as, for example, heptene, octene, or octadecene; substituted aromatic compounds such as, for example, octylbenzene, nonylbenzene, dodecylbenzene, or 1,1,3,3-tetramethylbutylbenzene; haloalkanes such as, for example, heptyl chloride, octyl chloride, 1,1,l-trichlorohexane, hexyl bromide, 1,11-dibromoundecane, and halogenated alkyl aromatic compounds such as, for example, p-chlorohexylbenzene and the like.

Compounds of Class II include: methyl laurate, butyl laurate, methyl oleate, butyl oleate, methyl stearate, isopropyl palmitate, isopropyl stearate, tributyl citrate, acetyl tributyl citrate, phenethyl benzoate, dibutyl phthalate, dioctyl phthalate, dioctyl terephthalate, bis(2-ethylhexyl) phthalate, butyl benzyl phthalate, diphenyl phthalate, dibutyl sebacate, didecyl succinate, and bis(2-ethylhexyl) azelate and the like.

Compounds of Class III include: lauramide, N-methyllauramide, N,N-dimethyllauramide, N,N-dibutyllauramide, N-decyl-N-methylacetamide, and N-oleylphthalimide and the like.

Compounds of Class IV include, for example, sulfates, sulfonates, sulfonamides, sulfoxides, phosphates, phosphonates, phosphinates, phosphites, or phosphine oxides. Particular examples include diesters of sulfuric acid, such as, for example, dihexylsulfate, didecylsulfate, and didodecylsulfate; esters of various alkyl sulfonic acids including, for example, methyl decanesulfonate, octyl dodecanesulfonate, and octyl p-toluenesulfonate; sulfoxides, including, for example, bis(2-ethylhexyl) sulfoxide; and sulfonamides, including, for example, N-(2-ethylhexyl)-p-toluenesulfonamide, N-hexadecyl-p-toluenesulfonamide, and N-2-ethylhexyl)-p-toluenesulfonamide. Phosphorus-containing compounds include, for example, triesters of phosphoric acid such as, for example, triphenyl phosphate, tritolylphosphate, trihexylphosphate, and tris(2-ethylhexyl)phosphate; various phosphonic acid esters, such as, for example, dihexyl hexylphosphonate, and dihexyl phenylphosphonate; phosphite esters such as tritolylphosphite, and phosphine oxides such as trioctylphosphine oxide.

Representative compounds are given below, along with their $LogP_{(calc)}$ value, calculated using the above-mentioned MedChem software package (version 3.54).

| | $LogP_{calc}$ |
|---|---|
| Nonreactive Compound | |
| hexane | 3.87 |

-continued

| | $LogP_{calc}$ |
|---|---|
| octane | 4.93 |
| decane | 5.98 |
| dodecane | 7.04 |
| hexadecane | 9.16 |
| dimethylphthalate | 1.36 |
| dibutylphthalate | 4.69 |
| bis(2-ethylhexyl)phthalate | 8.66 |
| dioctylphthalate | 8.92 |
| tritolylphosphate | 6.58 |
| tris(2-ethylhexyl)phosphate | 9.49 |
| dodecylbenzene | 8.61 |
| bis(2-ethylhexyl)azelate | 9.20 |
| trioctylphosphine oxide | 9.74 |
| dinonyl phthalate | 9.98 |
| didecyl phthalate | 11.04 |
| didodecyl phthalate | 13.15 |
| 3-(4-hydroxy-3,5-di-t-butylphenyl)-propionic acid, octadecyl ester | 14.07 |
| trioctyl amine | 10.76 |
| Monomer | |
| acrylic acid | 0.16 |
| isopropyl acrylamide | 0.20 |
| β-(hydroxyethyl)methacrylate | 0.25 |
| vinyl acetate | 0.59 |
| methyl acrylate | 0.75 |
| methyl methacrylate | 1.06 |
| ethyl acrylate | 1.28 |
| ethyl methacrylate | 1.59 |
| butyl acrylate | 2.33 |
| butyl methacrylate | 2.64 |
| styrene | 2.89 |
| divinyl benzene | 3.59 |
| mixture of vinyl toluenes | 3.37 |
| 2-ethylhexyl acrylate | 4.32 |
| 2-ethylhexyl methacrylate | 4.62 |
| t-butylstyrene | 4.70 |
| lauryl methacrylate | 6.88 |
| stearyl methacrylate | 10.05 |

The hydrophobic compound is employed in an amount of at least about 0.01, preferably at least about 0.05 and most preferably at least about 0.5 percent by weight based on the weight of the monomer. Hexadecane is the preferred non-reactive compound.

The hydrophobic compound can also be the polymerization initiator. Especially effective are peroxides with long alkyl chains such as lauroyl peroxide which has a $logP_{(calc)}$ of 10.61. Additionally, the hydrophobe can be a chain transfer agent such as N-dodecanethiol which has a $logP_{(calc)}$ of 6.47, or it can be a polymerizable monomer such as lauryl methacrylate or stearyl methacrylate.

Suitable ethylenically unsaturated monomers which are useful to practice the present invention include, for example, the following monomers and their mixtures: alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, stearyl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, and butyl acrylamide, vinyl acetate, vinyl propionate, vinylidene chloride, vinyl chloride, and vinyl aromatic compounds such as styrene, t-butyl styrene, ethyl vinyl benzene, vinyl toluene, dialkyl maleates, dialkyl itaconates, dialkyl malonates, isoprene, and butadiene. Crosslinking and grafting monomers which may be used together with the foregoing monomers to crosslink the polymer particles are polyfunctional with respect to the polymerization reaction, and may include, for example, esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, esters of saturated glycols or diols with unsaturated monocarboxylic acids, such as ethylene glycol diacrylate, ethylene glycol dimethacrylate, triethylene glycol dimethacrylate, 1,4butanediol dimethacrylate, 1,3-butanediol dimethacrylate, and polyfunctional aromatic compounds such as divinyl benzene.

The water-insoluble lubricants useful for the practice of the present invention include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, higher fatty acid esters, higher fatty acid amides, polyhydric alcohol esters of higher fatty acids, etc. disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, and the like. Lubricants useful in the present invention are described in further detail in Research Disclosure No.308119, published December 1989, page 1006.

The polymerization process is initiated in general with free radical initiators. Free radicals of any sort may be used. Preferred initiators include persulfate, peroxides, azo compounds, and redox initiators. Organic peroxides and organic peresters include, for example, benzoyl peroxide, dichlorobenzoyl peroxide, dicumyl peroxide, di-tert-butyl peroxide, 2,5-dimethyl2,5-di(peroxybenzoate)hexine-3, 1,4-bis(tert-butylperoxyisopropy)benzene, lauroyl peroxide, tert-butyl peracetate, 2,5-dimethyl-2,5-di(tert-butylperoxy) hexine-3, 2,5-dimethyl-2,5-di(tert-butylperoxy)hexane, tert-butyl perbenzoate, tert-butyl perphenyl acetate, tert-butylperisobutylate, tert-butyl per-secoctoate, tert-butyl perpivalate, cumyl perpivalate and tert-butyl perdiethyl acetate, and azo compounds include, for example, azobisisobutylnitrile and dimethyl azoisobutylate. Chain transfer agents may also be used to control the properties of the polymer particles formed.

In general, the weight percent of the water insoluble lubricant in the polymer particle can be anywhere from 1 to 90 wt %, preferably from about 5 to 50 wt %, and most preferably from about 10 to 50 wt %.

Imaging elements according to this invention can be of many different types depending on the particular use for which they are intended. Such elements include, for example, photographic, electrophotographic, electrostatographic, photothermographic, migration, electrothermographic, dielectric recording and thermal-dye transfer imaging elements. Photographic elements can differ widely in structure and composition. For example, they can vary greatly in regard to the type of the support, the number and composition of the imaging forming layers, and the kinds of auxiliary layers that are included in the elements. In particular, the photographic elements can be still films, motion picture films, x-ray films, graphic arts films, paper prints or microfiche. They can be black-white elements, color elements adapted for use in a negative-positive process, or color elements adapted for use in a reversal process. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like.

The polymer particles of the present invention are preferably coated in combination with a binder to form a surface protective layer for imaging elements. Any suitable binders can be used. They include hydrophilic colloids such as gelatin as well as hydrophobic polymer resin binders. The actual amount of binder and polymer particle will vary depending on the types of applications. It is preferred that the binder is coated at a weight ratio to the polymer particle from about 1:100 to 100:1, and more preferably from 20:80 to 95:5.

Useful resin binders include polyurethanes (e.g. Neorez R960 sold by ICI), cellulose acetates (e.g. cellulose diacetate, cellulose acetate butyrate, cellulose acetate propionate), poly(methyl methacrylate), polyesters (e.g. Vitel R sold by Goodyear Tire & Rubber Co.), polyamides (e.g. Unirez sold by Union Camp, Vesamide sold by General Electric Co.), polycarbonates (e.g. Makrolon sold by Mobay Chemical Co., Lexan sold by General Electric Co.), polyvinyl acetate, and the like.

Any suitable hydrophilic binder can be used in practice of this invention, such as naturally occurring substances such as proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

The coating composition of the invention can be applied by any of a number of well-know techniques, such as dip coating, rod coating, blade coating, air knife coating, gravure coating and reverse roll coating, extrusion coating, slide coating, curtain coating, and the like. The polymer particles and the binder are mixed together in a liquid medium to form a coating composition. After coating, the layer is generally dried by simple evaporation, which may be accelerated by known techniques such as convection heating. Known coating and drying methods are described in further detail in Research Disclosure No. 308119, Published December 1989, pages 1007 to 1008.

Good surface lubricity can be obtained by coating the polymer particles of the present invention at a coverage of greater than 5 $mg/m^2$. In principle, the upper value of the polymer particle coverage is limited actually by physical appearances of the surface rather than by the friction values of the layer. For example, if the coverage is too high, a hazy looking surface will appear, which therefore can have an effect on the sensitometric properties of the imaging element. The lower limiting value is set by the requirement on the surface friction value of the lubricant layer, which is determined by both manufacturing processes and applications of the imaging element.

A preferred imaging element according to the present invention comprises one or more imaging layers on one side of the support and the said surface protective layer present on the other side of the support as an outermost backing layer, or an outermost layer coated on the top of an abrasion resistance backing layer, or an outermost layer coated on the top of an antistatic layer, or an outermost layer coated on an magnetic recording layer. The surface protective layer can contain additives such as magnetic recording particles, abrasive particles, conductive polymers, conductive metal oxide particles, coating aids, charge control surfactants, matting agents, crosslinkers, and a secondary lubricant. There are no particular limits on the secondary lubricants that may be used. They may include, for example, polyether or polyester modified polysiloxane polymers, stearamide, oleamides, stearic acid, lauric acid, ethylene glycol distearate, ethylene glycol monostearate, and the like.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like. The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

1.) color developing → bleach-fixing → washing/stabilizing;

2.) color developing → bleaching → fixing → washing/stabilizing;

3.) color developing → bleaching → bleach-fixing → washing/stabilizing;

4.) color developing → stopping → washing → bleaching → washing → fixing → washing/stabilizing;

5.) color developing → bleach-fixing → fixing → washing/stabilizing;

6.) color developing → bleaching → bleach-fixing → fixing → washing/stabilizing;

Among the processing steps indicated above, the steps 1), 2), 3), and 4) are preferably applied. Additionally, each of the steps indicated can be used with multistage applications as described in Hahm, U.S. Pat No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The present invention will now be described in detail with reference to examples; however, the present invention should not be limited by these examples.

EXAMPLES

Example 1: (Invention)

To a beaker are added the following ingredients: 480 g methyl methacrylate, 320 g Lumiflon LF200F which is a fluorinated polymer made of perfluoroolefin and vinyl ether sold by Zeneca Resin, 8 g hexadecane, 24 g Aerosol OT-100 (dioctyl ester of sodium sulfosuccinic acid), and 8.6 g 2,2'-azobis(2,4-dimethylvaleronitrile) sold by DuPont under the trade name Vazo 52. The ingredients are stirred until all the solids are dissolved. This solution is added to 2520 g distilled water and stirred with a marine prop type agitator for 5 minutes. The mixture was passed through a Gaulin Mill operated at 3600 rpm, 0.5 gallon/minute flow and a gap of 0.01 inches. This material is then passed through a Crepaco homogenizer operated at 5000 psi to form the final droplet size. 1000 g of the droplet dispersion is placed in a bottle. The bottle is sealed and reacted in a tumble bath at 52 degrees C. for 16 hours. The particle prepared by this process is stable and filters well, and has a mean size of 280 nm.

Example 2: (Comparative)

A stirred reactor containing 624.9 g of deionized water and 3.35 g of Rhodapex CO-436 (Rhone-Poulenc) is heated to 80° C. and purged with $N_2$ for 1 hour. After addition of 0.5 g of potassium persulfate, an emulsion containing 5 g of deionized water, 141 g of methyl methacrylate, 2.97 g of ethylene glycol dimethacrylate, 4.64 g of allyl methacrylate, 75 g of Lumiflon LF200F which is a fluorinated polymer made of perfluoroolefin and vinyl ether sold by Zeneca Resin, 3.35 g of Rhodapex CO-436 (Rhone-Poulenc), and 0.25 g of potassium persulfate is slowly added over a period of 1 hour. The reaction medium is completely coagulated after 2 hours of polymerization.

Example 3: (Invention)

To a beaker are added the following ingredients: 255 g methyl methacrylate, 127 g stearyl methacrylate, 127.5 g ethylene glycol dimethacrylate, 90 g light mineral oil (Fisher Scientific), 5 g hexadecane, 16.8 g Aerosol OT-100 (dioctyl ester of sodium sulfosuccinic acid), and 9 g 2,2'-azobis(2,4-dimethylvaleronitrile) sold by DuPont under the trade name Vazo 52. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco homogenizer operated at 5000 psi to form the final droplet size. 1000 g of the droplet dispersion is placed in a bottle. The bottle is sealed and reacted in a tumble bath at 52 degrees C. for 16 hours. The particle prepared by this process is stable and filters well, and has a mean size of 146 nm.

Examples 4 to 8

The following examples show that the polymer particles of the invention provide transparent films with excellent frictional characteristics (i.e., low coefficient of friction values) when they are coated in combination with other polymers such as a water-dispersible polyurethane. A backing layer composition comprising a mixture of polymer particles as prepared in Example 3 and a commercially available polyurethane dispersion (Witcobond 232, Witco Corp.) is applied onto a polyester support previously coated with a Ag-doped vanadium pentoxide containing antistatic layer. The backing layers contained 2.5, 7.5, 10, and 20 weight % polymer particles in Example 5, 6, 7, and 8, respectively and are applied at a total dry coating weight of 1000 mg/m$^2$. Comparative sample 4 has a backing layer that comprises only the polyurethane. The coatings are tested for coefficient of friction (COF) using the methods set forth in ANSI IT 9.4-1992. The results are tabulated in Table 1.

TABLE 1

| Coating | COF |
|---|---|
| Example 4 (Comparative) | 0.4 |
| Example 5 | 0.28 |

TABLE 1-continued

| Coating | COF |
|---|---|
| (Invention) | |
| Example 6 (Invention) | 0.27 |
| Example 7 (Invention | 0.23 |
| Example 8 (Invention) | 0.22 |

Examples 9 to 11

The following examples demonstrate that the polymer particles of the present invention provide excellent surface lubricity when coated in combination with gelatin. A series of coatings are prepared by applying aqueous coating solutions containing lime-processed gelatin and polymer particles of the invention onto a poly(ethylene terephthalate) film support that has been subbed in sequence with a terpolymer latex (vinylidene chloride, methyl acrylate, and itaconic acid) layer and a gelatin layer. The coating is chill-set at 4.5° C. and dried first at 21° C. and then at 37.8° C. The resultant coatings have excellent appearance.

The coefficient of friction (COF) is determined using the methods set forth in ANSI IT 9.4-1992. The compositions and the results for these coatings are listed in Table 2.

TABLE 2

| Sample | Gelatin Coverage ($mg/m^2$) | Polymer Particle/ Coverage ($mg/m^2$) | COF |
|---|---|---|---|
| Example 9 (Comparison) | 861 | 0 | 0.48 |
| Example 10 (Invention) | 717 | 122 (P-1*) | 0.31 |
| Example 11 (Invention) | 717 | 122 (P-2**) | 0.34 |

*P-1 is prepared as in Example 3 but loaded with a liquid paraffin Linpar 14 V (Condea Vista Company) at a polymer to lubricant ratio of 85 to 15. P-1 has a particle size of about 189 nm.
**P-2 is prepared as in Example 3.

The invention has been described in detail with particular reference to certain preferred embodiments thereof, but it will be understood that variations and modifications can be effected within the spirit and scope of the invention.

What is claimed is:

1. A method of forming an imaging element comprising:

providing a support having at least one light sensitive layer;

mechanically forming droplets having a size less than 250 nm of an ethylenically unsaturated monomer and hydrophobic groups, the hydrophobic groups having a $\log P_{(calc)}$ greater than a $\log P_{(calc)}$ of the ethylenically unsaturated monomer by at least 1 unit, and a water insoluble lubricant;

polymerizing said droplets in the presence of a dispersing agent so that the polymerized droplets have a size of less than 250 nm;

coating the polymerized droplets and a binder over said at least one light sensitive layer; and drying the polymerized droplets and the binder to form a surface protective layer.

2. The method of claim 1 wherein the hydrophobic groups are selected from the group consisting of alkanes, alkenes, substituted aromatic compounds, haloalkanes, methyl laurate, butyl laurate, methyl oleate, butyl oleate, methyl stearate, isopropyl palmitate, isopropyl stearate, tributyl citrate, acetyl tributyl citrate, phenethyl benzoate, dibutyl phthalate, dioctyl phthalate, dioctyl terephthalate, bis(2-ethylhexyl) phthalate, butyl benzyl phthalate, diphenyl phthalate, dibutyl sebacate, didecyl succinate, bis(2-ethylhexyl) azelate, lauramide, N-methyllauramide, N,N-dimethyllauramide, N,N-dibutyllauramide, N-decyl-N-methylacetamide, N-oleylphthalimide, sulfates, sulfonates, sulfonamides, sulfoxides, phosphates, phosphonates, phosphinates, phosphites, and phosphine oxides.

3. The method of claim 1 wherein the ethylenically unsaturated monomer is selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinyl acetate, vinyl propionate, vinylidene chloride, vinyl chloride, styrene, t-butyl styrene, ethyl vinyl benzene, vinyl toluene, dialkyl maleates, dialkyl itaconates, dialkyl malonates, isoprene, and butadiene.

4. The method of claim 1 wherein the droplets further comprise crosslinking or grafting monomers selected from the group consisting of, esters of unsaturated monohydric alcohols with unsaturated monocarboxylic acids, esters of saturated glycols with unsaturated monocarboxylic acids, esters of diols with unsaturated monocarboxylic acids, and divinyl benzene.

5. The method of claim 1, wherein the water insoluble lubricant is selected from the group consisting of silicone based materials, fatty acids, fatty acid derivatives, alcohols, alcohol derivatives, fatty acid esters, fatty acid amides, polyhydric alcohol esters of fatty acids, paraffin, carnauba wax, natural waxes, synthetic waxes, petroleum waxes, mineral waxes, and fluoro-containing materials.

6. The method of claim 1 wherein the polymerizing step is initiated with a free radical initiator selected from the group consisting of persulfates, peroxides, azo compounds, and redox initiators.

7. The method of claim 6 wherein the free radical initiator is present in an amount of from 0.01% to 2% by the weight of monomer.

8. The method of claim 1 wherein the polymerizing step is carried out in the presence of gelatin.

9. The method of claim 1 wherein the support is selected from the group consisting of papers, glass, acetate polymers and polyesters.

10. The method of claim 1 wherein the binder is selected from the group consisting of polyurethanes, cellulose acetates, poly(methyl methacrylate), polyesters, polyamides, polycarbonates, polyvinyl acetate, proteins, protein derivatives, cellulose derivatives, polysaccharides, poly(vinyl lactams), acrylamide polymers, poly(vinyl alcohol), derivatives of poly(vinyl alcohol), hydrolyzed polyvinyl acetates, polymers of methacrylates, polymers of alkyl acrylates, polymers of sulfoalkyl acrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, copolymers containing styrene sulfonic acid, and gelatin.

11. A method of forming an imaging element comprising:

providing a support having at least one imaging layer;

mechanically forming droplets having a size less than 250 nm of an ethylenically unsaturated monomer having a $\log P_{(calc)}$ greater than 4, and a water insoluble lubricant;

polymerizing said droplets in the presence of a dispersing agent so that the polymerized droplets have a size of less than 250 nm;

coating the polymerized droplets and a binder on said support; and drying the polymerized droplets and the binder to form a layer superposed on said support.

12. The method of claim 11 wherein the ethylenically unsaturated monomer is selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinylidene chloride, t-butyl butyl styrene, dialkyl maleates, dialkyl itaconates, and dialkyl malonates.

13. The method of claim 11 wherein the droplets further comprise crosslinking or grafting monomers selected from the group consisting of, esters of unsaturated monohydric alcohols with unsaturated monocarboxylic acids, esters of saturated glycols with unsaturated monocarboxylic acids, esters of diols with unsaturated monocarboxylic acids, and divinyl benzene.

14. The method of claim 11 wherein the polymerizing step is initiated with a free radical initiator selected from the group consisting of persulfates, peroxides, azo compounds, and redox initiators.

15. The method of claim 14 wherein the free radical initiator is present in an amount of from 0.01% to 2% by the weight of monomer.

16. The method of claim 11, wherein the water insoluble lubricant is selected from the group consisting of silicone based materials, fatty acids, fatty acid derivatives, alcohols, alcohol derivatives, fatty acid esters, fatty acid amides, polyhydric alcohol esters of fatty acids, paraffin, carnauba wax, natural waxes, synthetic waxes, petroleum waxes, mineral waxes, and fluoro-containing materials.

17. The method of claim 11 wherein the polymerizing step is carried out in the presence of gelatin.

18. The method of claim 11 wherein the support is selected from the group consisting of papers, glass, acetate polymers and polyesters.

19. The method of claim 11 wherein the binder is selected from the group consisting of polyurethanes, cellulose acetates, poly(methyl methacrylate), polyesters, polyamides, polycarbonates, polyvinyl acetate, proteins, protein derivatives, cellulose derivatives, polysaccharides, poly(vinyl lactams), acrylamide polymers, poly(vinyl alcohol), derivatives of poly(vinyl alcohol), hydrolyzed polyvinyl acetates, polymers of methacrylates, polymers of alkyl acrylates, polymers of sulfoalkyl acrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, copolymers containing styrene sulfonic acid, and gelatin.

* * * * *